US005380484A

United States Patent [19]

Woods et al.

[11] Patent Number: 5,380,484

[45] Date of Patent: Jan. 10, 1995

[54] CONTROL OF MARINE BORERS BY CHLOROTHALONIL

[75] Inventors: Thomas L. Woods, Mentor, Ohio; Lawrence J. Cookson, Victoria, Australia

[73] Assignee: ISK Biotech Corporation, Mentor, Ohio

[21] Appl. No.: 939,679

[22] Filed: Sep. 3, 1992

[51] Int. Cl.[6] ..... B08B 17/00

[52] U.S. Cl. ..... 422/6; 514/129; 514/256

[58] Field of Search ..... 558/327, 419; 422/6; 514/129, 347, 132, 256, 494, 89, 187, 191, 316; 524/72, 208, 78.09

[56] References Cited

U.S. PATENT DOCUMENTS

| | | | |
|---|---|---|---|
| 3,290,353 | 12/1966 | Battershell et al. | 558/419 |
| 3,575,123 | 4/1971 | Shepard et al. | 114/67 R |
| 4,029,818 | 6/1977 | Jurd et al. | 422/6 |
| 4,273,833 | 6/1981 | De Long | 428/411 |
| 4,329,277 | 5/1982 | Murphy | 524/208 |
| 4,401,703 | 8/1983 | Rodgers | 428/72 |
| 4,631,302 | 12/1986 | Supcoe et al. | 523/122 |
| 4,666,747 | 5/1987 | Quinn | 427/421 |
| 5,185,357 | 2/1993 | Inui | 514/372 |

OTHER PUBLICATIONS

Chemical Abstracts, vol. 107, No. 1, p. 100, 9064j, Shipworm Attack on Logs and its Prevention, Tsunoda et al.

*Primary Examiner*—Robert J. Warden
*Assistant Examiner*—Krisanne M. Thornton
*Attorney, Agent, or Firm*—Fay, Sharpe, Beall, Fagan, Minnich & McKee

[57] ABSTRACT

The present invention relates to treatment of marine borer infestation. It has been found that wood can be effectively protected from marine borer infestation by impregnating the wood with a pesticidally effective amount of chlorothalonil. In general, the quantity of chlorothalonil employed is in the range of from about 0.3 to about 3.0 pounds per cubic foot, although higher concentrations can be employed.

12 Claims, 1 Drawing Sheet

BIOLOGICAL FILTRATION SYSTEM FOR THE CULTURE OF MARINE BORERS. ARROWS SHOW DIRECTION OF WATER FLOW GENERATED BY AIRLIFT.

S = CRUSHED SHELLS ON A MAT OF 'FILTER FIBRE'.

CONTROL OF MARINE BORERS BY CHLOROTHALONIL

BACKGROUND OF THE INVENTION

The present invention relates to the control of marine borers using chlorothalonil (2, 4, 5, 6-tetrachloro-isophthalonitrile).

There are a number of conventional preservatives and techniques for preventing the biodegradation of wood in soil contact. However, most of these materials and techniques prove much less effective in a marine environment. The use of creosote treated wood is well known, and is often reasonably effective against some organisms and in cold water marine environments. In warmer waters where crustacean borers are often quite prevalent creosote treatment has proven far less effective, and against some species almost totally ineffective.

In an article entitled "Marine Wood Biodeterioration and Wood Boring Crustaceans" (Proceedings-Marine Biodegradation GOA pages 167–188; 1986), the author, P. J. Boyle, notes that today creosote is by far the most widely-used preservative in marine environments but that where replacing wood piles is difficult or impossible, reinforced concrete piles are often used in spite of their significantly higher cost. The article also notes that appropriate concentrations of creosote provide good protection against all of the economically important marine wood borers except the Limnoria species, especially *Limnoria tripunctata.*

The article goes on to note that the only wood preservatives with effectiveness against Linmoria borers are chromated copper arsenate (CCA), ammoniacal copper arsenate (ACA), and tributyl tin oxide (TBTO). Unfortunately, while these heavymetal preservatives provide substantially improved protection against borers, they can also significantly reduce the strength of wood, leaving the piles brittle. In addition, these materials raise significant environmental concerns because of the highly toxic nature of the heavy metals that they contain.

A publication of the United States Department of Agriculture Forest Service, "Comparison of Preservative Treatments in Marine Exposure of Small Wood Panels" by Johnson and Gutzmer, published in Apr. 1990, also discusses the difficulty of treating wood to control Limnoria species. The article details results of testing of a variety of different preservative candidates including oil-type preservatives, waterborne preservatives, dual treatments and chemical modification. Among the waterborne preservatives evaluated were the chromated copper arsenate and other heavy metal arsenates of the type discussed by Boyle. The attempted chemical modifications involved the use of propylene oxide, butylene oxide, butylisocyanate and dimethylformamide. The oil type preservative systems evaluated involved various grades of creosote, either alone or in conjunction with insecticides such as chlorinated hydrocarbons, and the article notes that an organophosphate compound, chlorpyrifos, imparted added resistance to Limnoria.

Limnoria is a tiny but very destructive crustacean that burrows just below the wood's surface. This creature bores not only for protection but also for food, digesting the wood. As wave action and friction wear away the weakened wood, the borer digs deeper for protection as well as for additional food. Collectively, masses of these creatures can narrow the diameter of an underwater pile at a rate of one inch or more per year, and at even higher rates in warm tropical waters, eventually causing the infested pile to take on a characteristic hourglass shape.

The most widely employed method of stopping an attack, once actually started, is to wrap the pile tightly with a plastic (about 30 mil in thickness) sheeting from well below the mud line to above the high water line. This will kill the existing borers by eliminating the oxygen supply, while also precluding a subsequent attack. Alternatively, other types of jacketing or chemical barriers have been tried. In every case, these procedures are complex and expensive.

It is one object of the present invention to provide a method of controlling marine borers.

It is another object of the present invention to provide a method of treating wood to prevent degradation by marine borers.

It is yet another object of the present invention to provide a method of preventing and controlling Limnoria infestations.

It is a still further object of the present invention to provide a method of preventing and/or controlling marine borer infestation in which the concentration of environmentally objectionable treatment agents can be substantially reduced.

SUMMARY OF THE INVENTION

Figure 1:
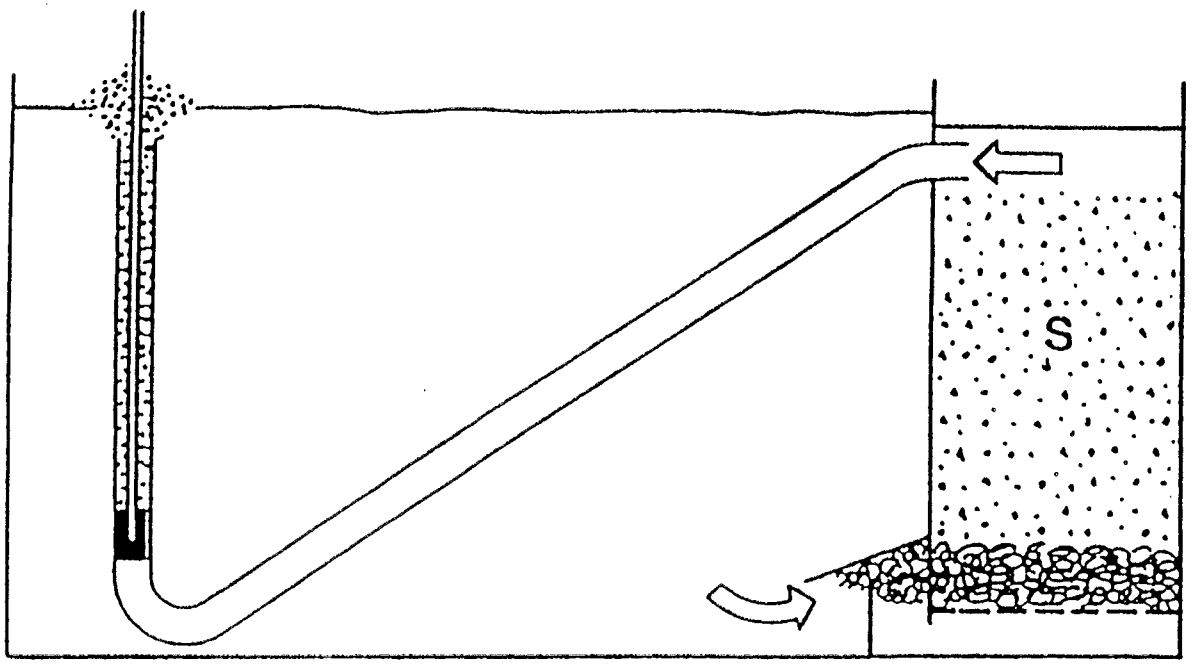
FIG. 1 is a diagrammatic illustration of the type of filtration devices employed in the comparative tests described hereinafter.

It has been found that wood can be effectively protected from marine borer infestation by impregnating the wood with a pesticidally effective amount of chlorothalonil. Chlorothalonil is a known fungicide, but has not heretofore been shown to possess activity against marine borers. In general, the quantity of chlorothalonil employed is in the range of from about 0.3 to about 3.0 pounds per cubic foot, although higher concentrations can be employed. It will, of course, be obvious that the effective concentration of chlorothalonil is a function of not only the specific type of wood to be protected, but also of the anticipated environment in which it is to be used (i.e. higher concentrations will obviously be required as more tropical marine conditions are encountered). Chlorothalonil has been found to be effective both alone, and also in conjunction with other borer control agents.

As examples of marine borers, mention may be made of the following which are presented by way of illustration and not by way of limitation:

I. Phylum Mollusca
- A. Family Teredinidae ("shipworms" or Teredinids)
  1. Genus Teredo, examples *T. navalis, T. diegensis*
  2. Genus Bankia, example *B. setacea*
  3. Genus Lyrodus, example *L. pedicellatus*
  4. Genus Psiloteredo, example *P. megotara*
- B. Pholads ("Piddocks")
  1. Genus Martesia, example *M. striata*
  2. Genus Xylophaga II. Phylum Crustacea
- A. Family Limnoriidae ("Gribbles")
  1. Genus Limnoria, examples *L. unicornis, L. indica, L. insulae, L. lignorum, L. tripunctata, L. quadripunctata*

B. Family Sphaeromatidae

1. Genus Sphaeroma, examples *S. terebrans, S. triste, S. quoyanum*

THE PREFERRED EMBODIMENT

In the preferred embodiment of the present invention, chlorothalonil is employed in a suitable liquid carrier wherein a biologically effective amount of chlorothalonil is impregnated into the wood. Generally, the preferred range of chlorothalonil is from about 0.3 to about 2.5 pounds per cubic foot of treated wood and the preferred concentration of chlorothalonil in the treating solution is generally in the range of from about 5 to about 10 percent by weight.

A particularly preferred embodiment of the present invention is the use of from about 0.3 to about, 2.0 pounds per cubic foot of a mixture of chlorothalonil in conjunction with CCA and/or chlorpyrifos, using from about 2 to about 20 percent by weight chlorothalonil and from about 0.1 to about 5.0 percent by weight CCA or chlorpyrifos in a heavy aromatic oil such as for example American Wood-Preservers Association (AWPA) type P9A oil.

The following examples will serve by way of illustration and not by way of limitation the effectiveness of chlorothalonil in aquatic environments and the preferred method of its application.

A series of tests were conducted to assess the efficacy of chlorothalonil, with or without the addition of chlorpyrifos, against three species of marine borers. Two of the borers were crustaceans from the family Limnoriidae, while the third was a mollusc from the family Teredinidae.

The preservative systems evaluated were 8% chlorothalonil in heavy aromatic oil, 8% chlorothalonil plus 0.5% chlorpyrifos in heavy aromatic oil, heavy aromatic oil alone, and Tanalith C (a commercial CCA treatment product).

1. Preparation of Treated Blocks

Sapwood from each of two trees of *Pinus radiata* and *Eucalyptus regnans* were cut into blocks measuring 10×5×25 mm in the grain direction. The blocks were conditioned to 12% moisture content, and treated so that the retentions for chlorothalonil and Tanalith C in *P. radiata* were 0.3, 0.6, 1.2, and 2.4 pcf (and 0.01875, 0.0375, 0.075, 0.15 pcf for chlorpyrifos). Retentions for *E. regnans* were the same, except that the highest mean retention of chlorothalonil possible was 1.875 pounds per cubic foot. Solvent control blocks were those treated with either heavy aromatic oil, toluene or water alone. Untreated blocks were also included, and these were the only unweathered blocks placed in tanks. Blocks were treated by drawing a vacuum (−90 kPa) for 30 minutes, introducing the preservative while under vacuum, and then immediately releasing the vacuum. The blocks were left to absorb preservative for 30 minutes at atmospheric pressure.

After treatment, all blocks (except toluene- and water-treated controls) were wrapped in aluminum foil and stored for two weeks at room temperature. This also ensured fixation of preservative within Tanalith C treated blocks. Blocks were then unwrapped and left to air-dry for two weeks. Blocks were then artificially weathered by vacuum impregnation with tap-water, and leaching in tap-water in a shaking water bath at 35° C. for 14 days. The water was changed ten times. Blocks were then vacuum oven dried at 40° C. for five days, and leached for a further seven days in seawater at 25° C. The seawater was changed five times. Some of the heavy oil was found to have condensed on the vacuum oven doors during weathering. The blocks were air dried to 12% MC, weighed, and then in random order attached with rubber bands to a series of glass rods which were to be placed in the appropriate tanks with marine borers.

2. Marine Borers and Bioassay

Three sets of three replicate 40 liter glass aquaria were used in this test, with each set containing a different species of marine borer:

*Limnoria tripunctata* is a crustacean with world-wide temperate distribution, and a high tolerance to creosote. The population was collected from creosote-treated *P. radiata* from Sydney Harbour, Australia, and supplemented at the start of the bioassay with fresh animals collected locally from Port Phillip Bay, Melbourne, Australia, in untreated pine bait blocks. Tanks were maintained at 24° C.

*Limnoria insulae* is a crustacean with a widespread tropical distribution. It was collected two years earlier from untreated turpentine at Magnetic Island in Queensland. Tanks were maintained at 26° C.

*Lyrodus pedicellatus* is a molluscan "shipworm" with world-wide temperate distribution. It was introduced to the tanks three months prior to bioassay, after collection from pine bait blocks located in Port Phillip Bay. The population was again supplemented midway through the bioassay period. Tanks were maintained at 20° C.

Each tank contained a biological filtration system illustrated in FIG. 1. This consisted of 7 liters (7.7 kg) of crushed shells which were less than 8 mm in diameter, but retained by a sieve with 2.4 mm apertures. The shell grit, which supports bacterial attachment, was placed on a mat of synthetic "filter fibre" which covered a plastic mesh base which was itself supported on glass Petri dishes. The water entrance to the biological filter was loosely packed with "filter fibre". This system prevented clogging of the shell grit with frass produced by borers. All frass was siphoned from the floor of the tank, and seawater replaced with local seawater from Sandringham, after one and three weeks of bioassay commencement, and monthly thereafter. The filter fibre packed in the entrance to the biological filter was also replaced bimonthly when it became clogged with frass. Water circulated through the system at about 20–30 l/h by use of an airlift. Water was kept at a salinity of 30 parts per thousand, and distilled water used to replace that lost by evaporation.

The Limnoriid borers were fed throughout the test with untreated *P. radiata* panels (130×230×6 mm) which hung from glass hooks in the tanks. *Lyrodus pedicellatus* was maintained in *P. radiata* blocks with lower surface area (35×90×150 mm). All borer species bred in the tanks. Two replicate blocks were placed in each tank, so there were six replicates for each marine borer species. Blocks were attached to glass rods, which were placed on the floor of tanks containing Limnoria, and about 50 mm below the water surface (and above feeder wood blocks) in tanks containing Lyrodus.

After 12 months exposure in the tanks, blocks were removed and air dried. Blocks from tanks containing *Lyrodus pedicellatus* were X-rayed to help determine the extent of internal damage to blocks. The population in one of the three tanks containing *Lyrodus pedicellatus* failed to become established, and so results for this tank are not included in the results. Blocks were inspected and rates on a scale of 0 to 4, where:

4.0=no attack 3.5=trace attack. Limnoria: etches only on wood surface. Lyrodus: burrow initiations, where hole is less than pediveliger diameter of about 0.35 mm, indicating full metamorphosis into adult was unsuccessful.

3.0=light/moderate attack. Limnoria: 1–3 burrows. Lyrodus: hole depth 1–2 times shell diameter.

2.5=moderate attack. Limnoria: 4–6 burrows, or more than 4–6 burrows but burrows confined to edges of block. Lyrodus: hole depth 2–3 times shell diameter.

2.0=moderate/heavy attack. Limnoria: 7–12 burrows over general surface. Lyrodus: several holes with depths 2–3 times shell diameter, or with several holes with depths 4–5 times shell diameter.

1.5=heavy attack. Limnoria: 13–24 burrows over general surface. Lyrodus: many holes 1–2 mm in length.

1.0=heavy/severe attack. Limnoria: many burrows over general surface. Lyrodus: some holes 3–8 mm long.

0.5=severe attack. Limnoria: numerous burrows, block beginning to loose outline of shape. Lyrodus: many holes up to 10 mm long.

0.0=fully destroyed. Limnoria: block lost shape. Lyrodus: entire cross-section honeycombed with burrows.

The results for *P. radiata* are set forth in Table 1, and those for *E. regnans* are set forth in Table 2.

TABLE 1

Rating of *P. radiate* blocks after 1 year against three species of marine borers. Mean of six replicates (*Lyrodus pedicellatus* with four replicates).

| Treatment & Retention (pcf) | *Limnoria tripunctata* Mean | Std. Dev. | *Limnoria insulae* Mean | Std. Dev. | *Lyrodus pedicellatus* Mean | Std. Dev. |
|---|---|---|---|---|---|---|
| Untreated | 0.7 | 0.3 | 1.8 | 0.4 | 0.8 | 0.3 |
| Water | 0.7 | 0.4 | 1.8 | 0.4 | 0.9 | 0.3 |
| Toluene | 0.8 | 0.4 | 1.7 | 0.3 | 0.6 | 0.3 |
| Heavy oil | 0.8 | 0.4 | 1.9 | 0.4 | 1.5 | 0.4 |
| 0.3 Chloro | 1.6 | 0.7 | 2.9 | 0.5 | 2.1 | 0.5 |
| 0.3 Ch/Ch * | 2.7 | 0.5 | 3.5 | 0.5 | 2.5 | 0.4 |
| 0.3 Tan C | 3.3 | 0.5 | 3.3 | 0.6 | 2.1 | 0.3 |
| 0.6 Chloro | 2.3 | 0.7 | 3.1 | 0.5 | 2.1 | 0.3 |
| 0.6 Ch/Ch * | 2.7 | 0.6 | 3.4 | 0.6 | 2.1 | 0.3 |
| 0.6 Tan C | 3.8 | 0.3 | 3.6 | 0.2 | 2.8 | 0.3 |
| 1.2 Chloro | 2.6 | 0.8 | 3.4 | 0.4 | 2.8 | 0.5 |
| 1.2 Ch/Ch * | 3.3 | 0.4 | 3.8 | 0.3 | 3.1 | 0.3 |
| 1.2 Tan C | 4.0 | 0.0 | 3.9 | 0.2 | 3.9 | 0.3 |
| 2.4 Chloro | 3.3 | 0.3 | 3.9 | 0.2 | 3.8 | 0.3 |
| 2.4 Ch/Ch * | 3.8 | 0.3 | 3.8 | 0.3 | 3.8 | 0.5 |
| 2.4 Tan C | 4.0 | 0.0 | 4.0 | 0.0 | 3.9 | 0.3 |

Chloro = chlorothalonil
Ch/Ch = chlorothalonil/chlorpyrifos
Tan C = Tanalith C
* = 0.01875, 0.0375, 0.075, and 0.15 respectively for chlorpyrifos

TABLE 2

Rating of *E. regnans* blocks after 1 year against three species of marine borers. Mean of six replicates (*Lyrodus pedicellatus* with four replicates).

| Treatment & Retention (pcf) | *Limnoria tripunctata* Mean | Std. Dev. | *Limnoria insulae* Mean | Std. Dev. | *Lyrodus pedicellatus* Mean | Std. Dev. |
|---|---|---|---|---|---|---|
| Untreated | 1.8 | 0.8 | 1.8 | 0.5 | 1.0 | 0.4 |
| Water | 2.0 | 0.5 | 1.7 | 0.3 | 1.0 | 0.4 |
| Toluene | 2.0 | 1.1 | 1.9 | 0.5 | 1.3 | 0.5 |
| Heavy oil | 2.7 | 0.9 | 3.0 | 0.6 | 1.8 | 0.3 |
| 0.3 Chloro | 3.2 | 1.0 | 3.5 | 0.6 | 2.1 | 0.3 |

TABLE 2-continued

Rating of *E. regnans* blocks after 1 year against three species of marine borers. Mean of six replicates (*Lyrodus pedicellatus* with four replicates).

| Treatment & Retention (pcf) | *Limnoria tripunctata* Mean | Std. Dev. | *Limnoria insulae* Mean | Std. Dev. | *Lyrodus pedicellatus* Mean | Std. Dev. |
|---|---|---|---|---|---|---|
| 0.3 Ch/Ch * | 3.8 | 0.4 | 3.7 | 0.4 | 2.4 | 0.5 |
| 0.3 Tan C | 3.5 | 1.0 | 3.8 | 0.3 | 1.8 | 0.3 |
| 0.6 Chloro | 3.4 | 0.4 | 3.7 | 0.4 | 3.0 | 0.4 |
| 0.6 Ch/Ch * | 3.7 | 0.8 | 3.9 | 0.2 | 3.4 | 0.5 |
| 0.6 Tan C | 4.0 | 0.0 | 3.9 | 0.2 | 3.0 | 0.4 |
| 1.2 Chloro | 3.8 | 0.3 | 3.9 | 0.2 | 3.4 | 0.6 |
| 1.2 Ch/Ch * | 3.8 | 0.3 | 4.0 | 0.0 | 3.8 | 0.3 |
| 1.2 Tan C | 4.0 | 0.0 | 4.0 | 0.0 | 3.9 | 0.3 |
| 1.875 Chloro | 3.9 | 0.2 | 3.9 | 0.2 | 3.8 | 0.3 |
| 1.875 Ch/Ch * | 4.0 | 0.0 | 4.0 | 0.0 | 3.9 | 0.3 |
| 1.875 Tan C | 4.0 | 0.0 | 4.0 | 0.0 | 3.9 | 0.3 |

Chloro = chlorothalonil
Ch/Ch = chlorothalonil/chlorpyrifos
Tan C = Tanalith C
* = 0.01875, 0.0375, 0.075, and 0.15 respectively for chlorpyrifos From a review of the data in Tables 1 and 2, it is clear that all three marine borers species were able to substantially degrade untreated and solvent-treated blocks. Of the borer species, *L. insulae* appeared to be the least active, probably because the population was not supplemented with large numbers of fresh specimens at the start of the test. For each borer species, the attack found on *P. radiata* or *E. regnans* was not significantly different (analysis of variance) whether untreated, or treated with water or toluene. Heavy oil alone had no significant effect on attack by *L. tripunctata;* however, the attack by *L. insulae* on *E. regnans* was significantly reduced compared to the other solvent control blocks. Although *L. pedicellatus* was able to heavily attack blocks treated with heavy oil, the attack in *P. radiata* was significantly lower than on other solvent control blocks, i.e. oil appeared to have some effect.

For each borer species, and at each retention level (0.3, 0.6, 1.2, 1.875 per cubic foot), there was no significant difference in level of attack of *E. regnans* blocks whether treated with chlorothalonil alone, chlorothalonil/chlorpyrifos, or Tanalith C. Even at the lowest retention of 0.3 pcf, both Limnoria species could produce only light attack on treated *E. regnans* blocks; however, *L. pedicellatus* was able to produce moderate to heavy degradation.

Decay tests in an accelerated field simulator show that heavy oil alone appears to offer wood some degree of protection, however, against marine borers this effect is not noticeable (*Linmoria tripunctata*) or of little consequence (*Lyrodus pedicellatus*).

Chlorothalonil, chlorothalonil/chlorpyrifos, and Tanalith C were effective in protecting *E. regnans* during the test period from Limnoria. *Lyrodus pedicellatus* produced more serious attack of *E. regnans* at the lowest retention (0.3 pcf), irrespective of the preservative used. In earlier work, *Lyrodus pedicellatus* also tended to attack CCA-treated *E. regnans* more severely than Limnoria.

There was little or no difference in the performance of *P. radiata* against *Limnoria insulae* and *Lyrodus pedicellatus* after treatment with either chlorothalonil, chlorothalonil/chlorpyrifos, or Tanalith C. Against *L. tripunctata,* treatments of *P. radiata* with chlorothalonil alone were less effective than with Tanalith C, however, the addition of chlorpyrifos to chlorothalonil improved performance.

While the foregoing examples clearly establish the efficacy of chlorothalonil by itself and/or in conjunction with small amounts of chlorpyrifos, it is contemplated that chlorothalonil can also be used in conjunction with other treatment agents and/or in various double treatment combinations of the type previously used, such as for example CCA/creosote. In particular, it is contemplated that a combination of chlorothalonil and creosote or CCA could prove highly effective.

It will, of course, be obvious to those skilled in the art that many substitutions, changes, and modifications can be made in the foregoing materials and procedures without departing from the scope of the invention herein disclosed.

Having thus described the invention, the following is claimed:

1. A method of protecting wood in an aquatic environment from marine borer infestation which comprises treating said wood by impregnating said wood with a pesticidally effective concentration of chlorothalonil.

2. The method according to claim 1 wherein said chlorothalonil is contained in a heavy oil dispersion.

3. The method of claim 1 wherein said chlorothalonil is contained in a solvent dispersion.

4. The method according to claim 1 wherein chlorpyifos is employed with said chlorothalonil and is present in a ratio by weight of from about 20:1 to about 4:1 chlorothalonil to chlorpyrifos.

5. The method according to claim 2 wherein chlorpyifos is employed with said chlorothalonil and is present in a ratio by weight of from about 20:1 to about 4:1 chlorothalonil to chlorpyrifos.

6. The method according to claim 3 wherein chlorpyifos is employed with said chlorothalonil and is present in a ratio by weight of from about 20:1 to about 4:1 chlorothalonil to chlorpyrifos.

7. The method according to claim 1 wherein said chlorothalonil is present in said wood in a concentration in the range of from about 0.3 to about 2.5 pounds per cubic foot.

8. The method according to claim 2 wherein said chlorothalonil is present in said wood in a concentration in the range of from about 0.3 to about 2.5 pounds per cubic foot.

9. The method according to claim 3 wherein said chlorothalonil is present in said wood in a concentration in the range of from about 0.3 to about 2.5 pounds per cubic foot.

10. The method according to claim 4 wherein said chlorothalonil is present in said wood in a concentration in the range of from about 0.3 to about 2.5 pounds per cubic foot.

11. The method according to claim 5 wherein said chlorothalonil is present in said wood in a concentration in the range of from about 0.3 to about 2.5 pounds per cubic foot.

12. The method according to claim 6 wherein said chlorothalonil is present in said wood in a concentration in the range of from about 0.3 to about 2.5 pounds per cubic foot.

* * * * *